US007789712B1

(12) United States Patent
Peng et al.

(10) Patent No.: US 7,789,712 B1
(45) Date of Patent: Sep. 7, 2010

(54) AUDIO JACK CONNECTOR

(75) Inventors: Yung-Chi Peng, Tu-Cheng (TW); Sheng-Yuan Huang, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/554,791

(22) Filed: Sep. 4, 2009

(51) Int. Cl.
*H01R 24/04* (2006.01)

(52) U.S. Cl. ..... 439/668; 439/669

(58) Field of Classification Search ..... 439/668, 439/669

See application file for complete search history.

(56) References Cited

U.S. PATENT DOCUMENTS 6,312,274 B1 * 11/2001 Lin ..... 439/188
6,869,315 B2 * 3/2005 Nakai et al. ..... 439/668
7,033,226 B1 * 4/2006 Chien et al. ..... 439/668
2006/0234563 A1 * 10/2006 Yang ..... 439/668

* cited by examiner

*Primary Examiner*—Tho D Ta
(74) *Attorney, Agent, or Firm*—Cheng-Ju Chiang

(57) ABSTRACT

An audio jack connector includes a dielectric housing and a plurality of contacts received in the dielectric housing. The dielectric housing defines an insertion hole therein for an audio plug inserted into. One of the contacts is located at a rear of the dielectric housing and includes a bottom plate, a first fixed plate and a second fixed plate respectively extended upward from two opposite ends of the bottom plate. A contact protuberance is protruded towards the second fixed plate from a portion of the first fixed plate. A flexible plate is extended from the second fixed plate to be located between the first and second fixed plates. The flexible plate defines a contact convex protruded towards the first fixed plate at a free end thereof. The contact protuberance and the contact convex are both projected into the insertion hole for contacting with the audio plug.

17 Claims, 4 Drawing Sheets

AUDIO JACK CONNECTOR

BACKGROUND OF THE INVENTION

1. Field of the Invention

The present invention relates to an electrical connector, and more particularly to an audio jack connector.

2. The Related Art

Audio jack connectors are widely used in kinds of electronic equipments, such as MP3/MP4, mobile phones, computers and other equipments for transmitting sound signals. A conventional audio jack connector includes an insulating housing and a terminal received in a rear of the insulating housing. The insulating housing defines an insertion hole for an audio plug inserted thereinto. The terminal has a base portion fixed in the insulating housing, and an elastic contact portion extended from the base portion and projected into the insertion hole. When the audio plug is inserted into the insulating housing, the elastic contact portion is contacted with a tip end of the audio plug.

The elastic contact portion of the terminal is contacted with the tip end of the audio plug by side, in other words, the elastic contact portion may push the audio plug aside. This will cause the audio plug contacted with other terminals of the audio jack connector incompletely, and as a result, signal transmission between the audio jack connector and the audio plug will be influenced.

SUMMARY OF THE INVENTION

It is an object of the present invention to provide an audio jack connector capable of securing a stable signal transmission. The audio jack connector adapted for receiving an audio plug includes a dielectric housing, and a plurality of contacts received in the dielectric housing. The dielectric housing defines an insertion hole extended from front to rear for receiving the audio plug from a front thereof. One of the contacts includes a bottom plate disposed at a bottom of the dielectric housing, a first fixed plate and a second fixed plate respectively erectly extended upward from two opposite ends of the bottom plate and disposed at two opposite sides of the insertion hole. A contact protuberance is protruded towards the second fixed plate from a portion of the first fixed plate. A flexible plate is extended from the second fixed plate to be located between the first and second fixed plates. The flexible plate defines a contact convex protruded towards the first fixed plate at a free end thereof. The contact protuberance and the contact convex are both projected into the insertion hole for contacting with the audio plug.

As described above, the contact protuberance of the first fixed plate and the contact convex of the flexible plate are both contacted with the audio plug, so the electrical connection between the contact and the audio plug is more stable.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
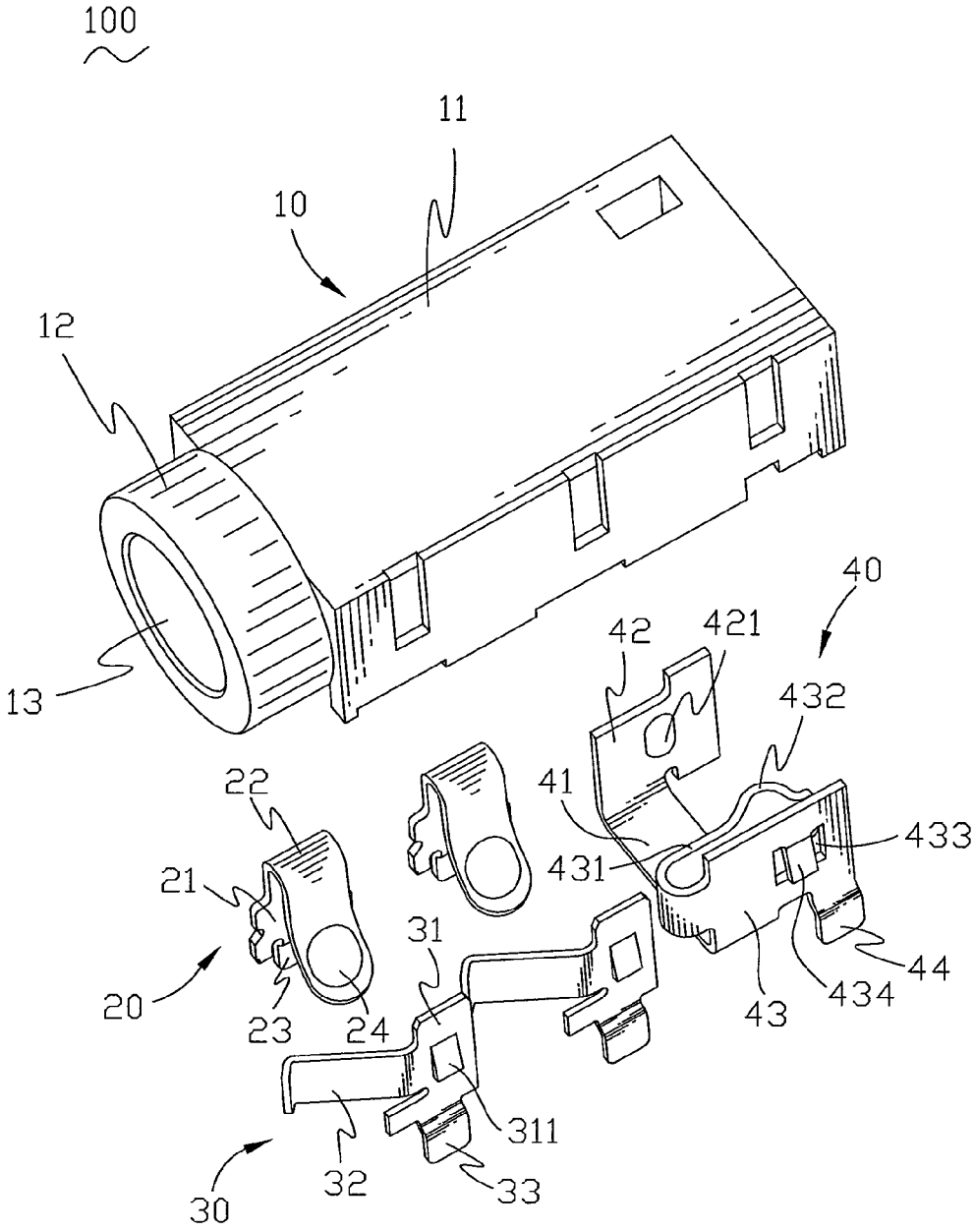
FIG. 1 is an exploded view of an audio jack connector in accordance with the present invention.
Figure 2:
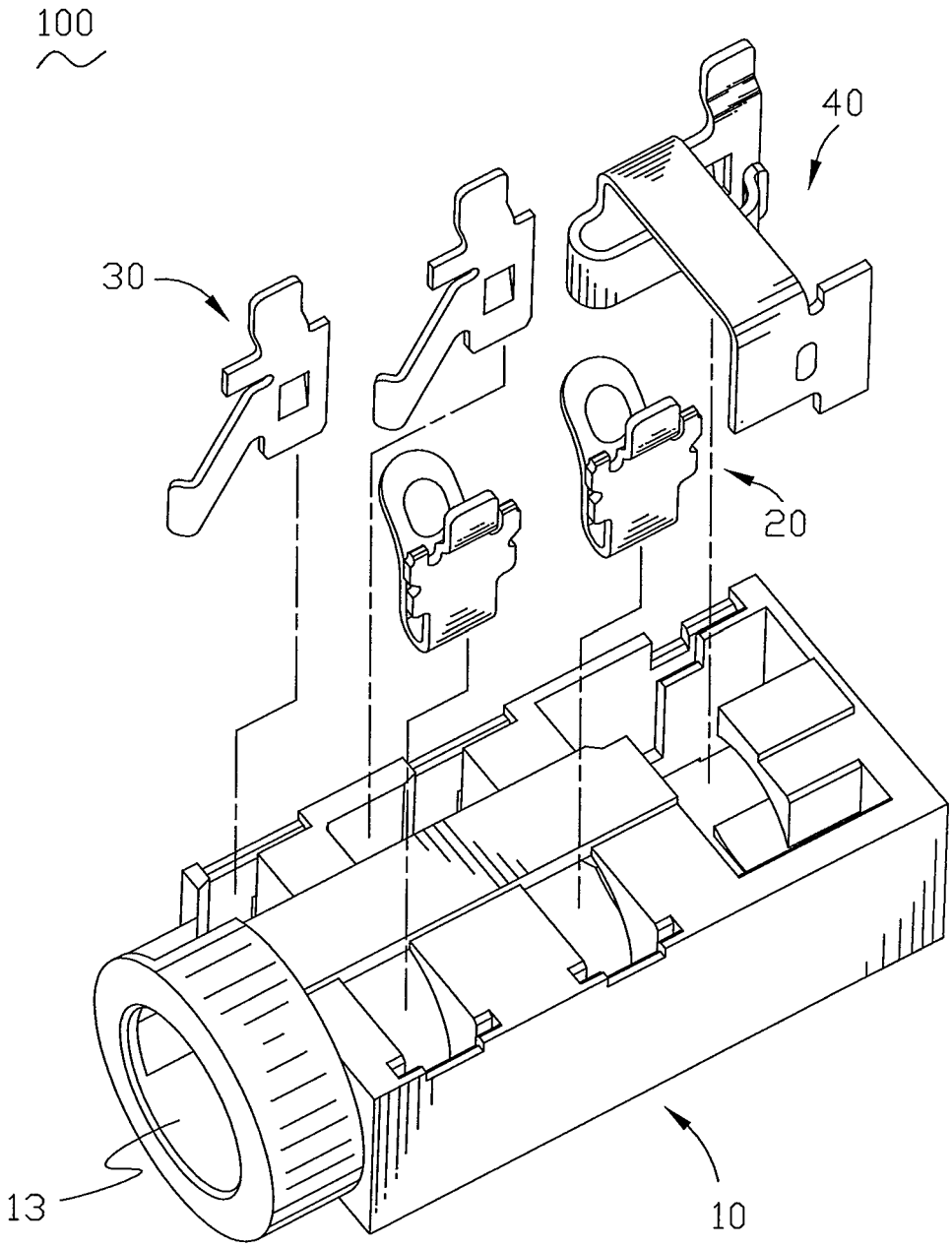
FIG. 2 is another exploded view of the audio jack connector shown in the FIG. 1.

With reference to FIGS. 1 and 2, an audio jack connector 100 according to the present invention is shown. The audio jack connector 100 includes a dielectric housing 10 and a plurality of contacts received in the dielectric housing 10. These contacts include a pair of first contacts 20, a pair of second contacts 30 and a third contact 40.

The dielectric housing 10 has a main body 11 showing rectangular parallelepiped shape and a cylindrical sleeve 12 integrally formed at front of the main body 11. The dielectric housing 10 defines an insertion hole 13 extended from front to rear to penetrate through the sleeve 12 and extend into the main body 11.

The pair of first contacts 20 are formed by bending a metal plate into a substantial R-shape and each has an upright fixed portion 21, a resilient portion 22 bent downward from a top edge of the fixed portion 21 and a soldered portion 23 extended downward from a bottom edge of the fixed portion 21. A contact projection 24 is provided at a concave part of the resilient portion 22.

The pair of the second contacts 30 are formed by bending a metal plate and each has an upright base portion 31, an elastic arm 32 bent and extended forward from a front edge of the base portion 31 and a soldered portion 33 extended downward from a bottom edge of the base portion 31. A fixed piece 311 is punched at the base portion 31 and slightly inclined outward.

The third contact 40 includes a bottom plate 41, a first fixed plate 42 and a second fixed plate 43 respectively erectly extended upward from two opposite ends of the bottom plate 41 and then extended rearward to beyond the bottom plate 41. A contact protuberance 421 is protruded towards the second fixed plate 43 from a substantial middle portion of the first fixed plate 42. A flexible plate 431 is extended and bent rearward from a front edge of the second fixed plate 43 to be located between the first fixed plate 42 and the second fixed plate 43. The flexible plate 431 defines a contact convex 432 by a free end thereof arched towards the first fixed plate 42. The second fixed plate 43 defines an opening 433 at a position corresponding to the contact convex 432 and a resistance piece 434 extended from an upper edge of the opening 433 and inclined opposite to the contact convex 432. A soldered portion 44 is extended downward from a rear of a bottom edge of the second fixed plate 43 and apart from the bottom plate 41.

In assembly, these contacts 20, 30, 40 are mounted to the dielectric housing 10. The first contacts 20 are located at one side of the dielectric housing 10 whereas the second contacts 30 are located at the other side of the dielectric housing 10 opposite the first contacts 20. The third contact 40 is located at a rear of the dielectric housing 10 with the bottom plate 41 disposed at a bottom of the dielectric housing 10 while the first and second fixed plates 42, 43 respectively disposed at two opposite sides of the insertion hole 13. The fixed pieces 311 of the second contacts 30 and the resistance piece 434 of the third contact 40 are against the dielectric housing 10. The contact projections 24 of the first contacts 20, the elastic arms 32 of the second contacts 30, the contact protuberance 421 and the contact convex 432 of the third contact 40 are all projected into the insertion hole 13. The soldered portions 23, 33, 44 are extended downward beyond the bottom of the dielectric housing 10 to be inserted and soldered to a PCB (not shown).

Figure 3:
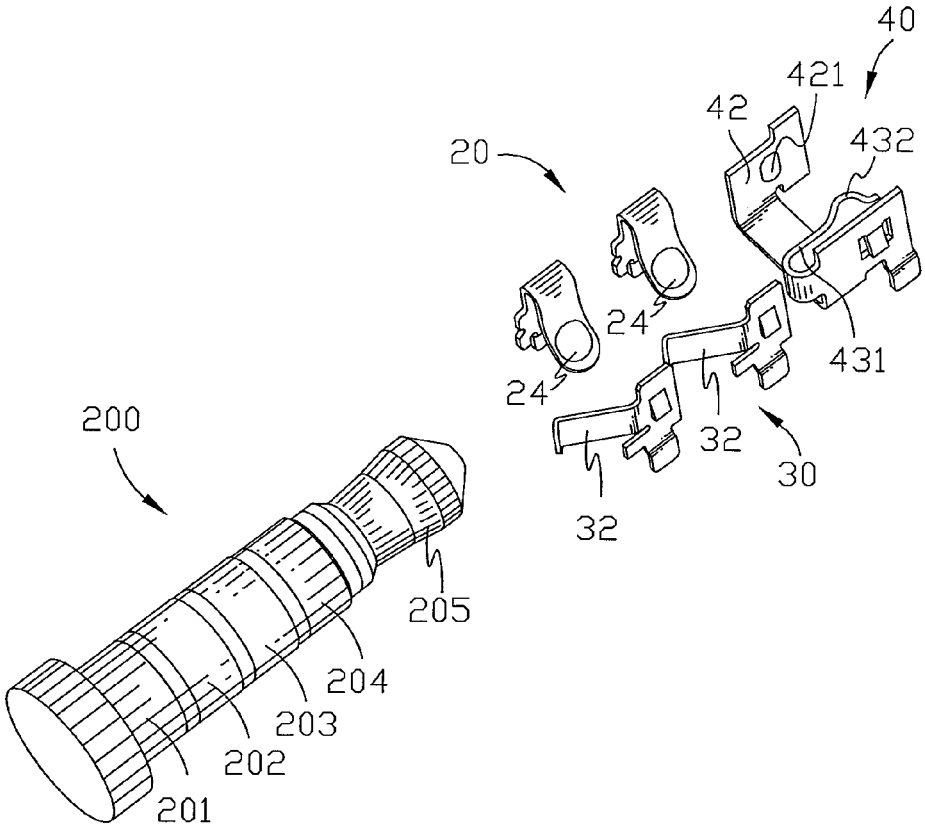
FIG. 3 shows a relationship between contacts of the audio jack connector and an audio plug being inserted thereinto.
Figure 4:
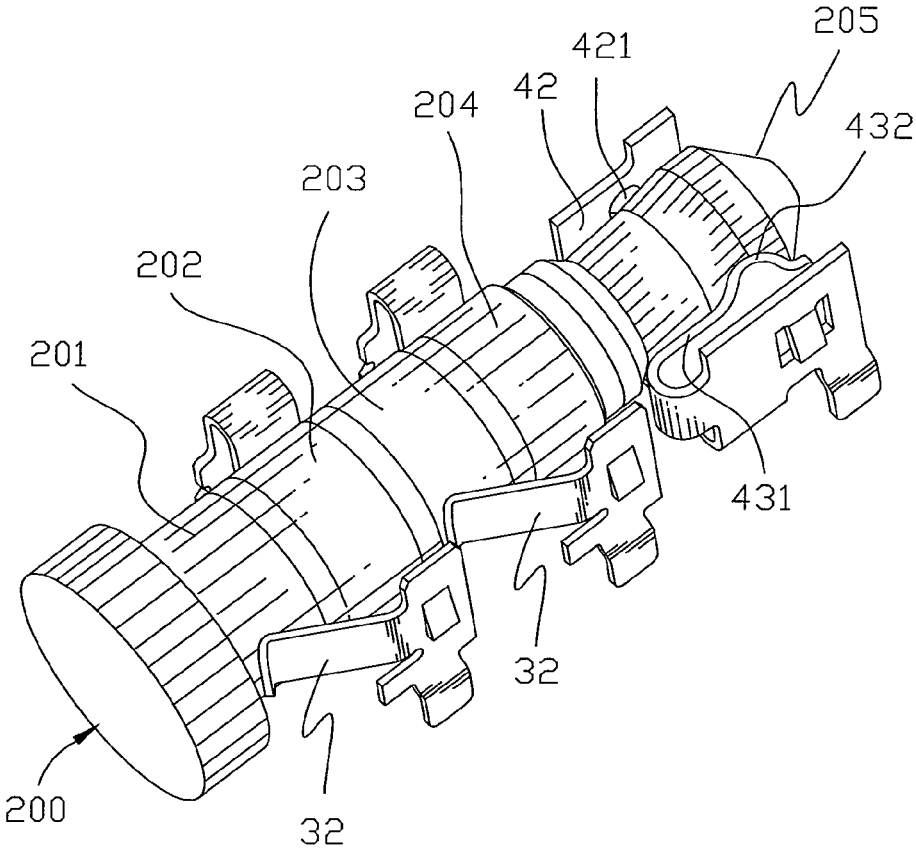
FIG. 4 shows a relationship between the contacts and the audio plug when the audio plug has been inserted thereinto.

As shown in FIG. 3, an audio plug 200 is inserted into the insertion hole 13 from a front of the audio jack connector 100 to be brought to contact with the contacts 20, 30, 40. Along the insertion direction, the audio plug 200 has first to fourth electrodes 201-204 and a tip electrode 205 in turn. As shown in FIG. 4, when the audio plug 200 is fully inserted into the audio jack connector 100, the contact projections 24 of the first contacts 20 are electrically contacted with the second and the fourth electrodes 202, 204 respectively, the elastic arms 32 of the second contacts 30 are electrically contacted with the first and the third electrodes 201, 203 respectively, and the tip electrode 205 is gripped between the first fixed plate 42 and the flexible plate 431 with the contact protuberance 421 and the contact convex 432 both contacted with the tip electrode 205. Therefore, the audio plug 200 is retained in the audio jack connector 100 more firmly, meanwhile, the electrical connection between the contacts 20, 30, 40 of the audio jack connector 100 and audio plug 200 are more stable.

As described above, because the tip electrode 205 of the audio plug 200 is gripped between the first fixed plate 42 and the flexible plate 431, the audio plug 200 is retained in the audio jack connector 100 more firmly. The contact protuberance 421 of the first fixed plate 42 and the contact convex 432 of the flexible plate 431 are both contacted with the tip electrode 205 of the audio plug 200, so the electrical connection between the third contact 40 and the audio plug 200 is more stable.

What is claimed is:

1. An audio jack connector for receiving an audio plug, comprising:

a dielectric housing defining an insertion hole extending from a front to a rear thereof for receiving the audio plug; and a plurality of contacts received in the dielectric housing, one of the contacts including a bottom plate disposed at a bottom of the dielectric housing, a first fixed plate and a second fixed plate respectively erectly extending upward from two opposite ends of the bottom plate and further extending rearward beyond the bottom plate, and disposed at two opposite sides of the insertion hole, a contact protuberance protruding towards the second fixed plate from a portion of the first fixed plate, a flexible plate extending from the second fixed plate to be located between the first and second fixed plates, the flexible plate defining a contact convex protruding towards the first fixed plate at a free end thereof, the contact protuberance and the contact convex both projecting into the insertion hole for contacting the audio plug.

2. The audio jack connector as claimed in claim 1, wherein the flexible plate is extended and bent rearward from a front edge of the second fixed plate.

3. The audio jack connector as claimed in claim 1, wherein the second fixed plate defines an opening at a position corresponding to the contact convex and a resistance piece extended from an upper edge of the opening and inclined opposite to the contact convex for against the dielectric housing.

4. The audio jack connector as claimed in claim 1, wherein a soldered portion is extended downward from a bottom edge of the second fixed plate and extended beyond the bottom of the dielectric housing.

5. The audio jack connector as claimed in claim 1, wherein the contact protuberance and the contact convex are used for contacting a tip electrode of the audio plug.

6. The audio jack connector as claimed in claim 1, wherein the contact convex is formed by the free end of the flexible plate arched towards the first fixed plate.

7. The audio jack connector as claimed in claim 1, wherein a soldered portion extends downward from a rear of a bottom edge of the second fixed plate and apart from the bottom plate to extend beyond the bottom of the dielectric housing.

8. The audio jack connector as claimed in claim 7, wherein the flexible plate is extended and bent rearward from a front edge of the second fixed plate.

9. An audio jack connector for receiving an audio plug, comprising:

a dielectric housing defining an insertion hole extending from a front to a rear thereof for receiving the audio plug; and a plurality of contacts received in the dielectric housing, one of the contacts including a bottom plate disposed at a bottom of the dielectric housing, a first fixed plate and a second fixed plate respectively erectly extending upward from two opposite ends of the bottom plate and disposed at two opposite sides of the insertion hole, a contact protuberance protruding towards the second fixed plate from a portion of the first fixed plate, a flexible plate extending from the second fixed plate to be located between the first and second fixed plates, the flexible plate defining a contact convex protruding towards the first fixed plate at a free end thereof, the contact protuberance and the contact convex both projecting into the insertion hole for contacting the audio plug;

wherein the second fixed plate defines an opening at a position corresponding to the contact convex and a resistance piece extending from an upper edge of the opening and inclined opposite to the contact convex for against the dielectric housing.

10. The audio jack connector as claimed in claim 9, wherein the flexible plate extends and bends rearward from a front edge of the second fixed plate.

11. The audio jack connector as claimed in claim 9, wherein a soldered portion extends downward from a bottom edge of the second fixed plate and extends beyond the bottom of the dielectric housing.

12. The audio jack connector as claimed in claim 9, wherein the contact protuberance and the contact convex are used for contacting a tip electrode of the audio plug.

13. The audio jack connector as claimed in claim 9, wherein the contact convex is formed by the free end of the flexible plate arched towards the first fixed plate.

14. An audio jack connector for receiving an audio plug, comprising:

a dielectric housing defining an insertion hole extending from a front to a rear thereof for receiving the audio plug; and a plurality of contacts received in the dielectric housing, one of the contacts including a bottom plate disposed at a bottom of the dielectric housing, a first fixed plate and a second fixed plate respectively erectly extending upward from two opposite ends of the bottom plate and disposed at two opposite sides of the insertion hole, a contact protuberance protruding towards the second fixed plate from a portion of the first fixed plate, a flexible plate extending from the second fixed plate to be located between the first and second fixed plates, the flexible plate defining a contact convex protruding towards the first fixed plate at a free end thereof, the contact protuberance and the contact convex both projecting into the insertion hole for contacting the audio plug;

wherein a soldered portion extends downward from a bottom edge of the second fixed plate and extends beyond the bottom of the dielectric housing.

15. The audio jack connector as claimed in claim 14, wherein the flexible plate extends and bends rearward from a front edge of the second fixed plate.

16. The audio jack connector as claimed in claim 14, wherein the contact protuberance and the contact convex are used for contacting a tip electrode of the audio plug.

17. The audio jack connector as claimed in claim 14, wherein the contact convex is formed by the free end of the flexible plate arched towards the first fixed plate.

* * * * *